US006282843B1

(12) United States Patent
Shibaike et al.

(10) Patent No.: US 6,282,843 B1
(45) Date of Patent: Sep. 4, 2001

(54) PNEUMATIC STRUCTURE

(75) Inventors: Hajime Shibaike, Ibaraki; Hiroshi Aoyagi, Tokyo; Isamu Saika; Yoshifusa Sekiya, both of Osaka; Koji Sato, Ibaraki; Toshiak Hisada, Tokyo, all of (JP)

(73) Assignee: Teijin Limited (JP)

( * ) Notice: Subject to any disclaimer, the term of this patent is extended or adjusted under 35 U.S.C. 154(b) by 0 days.

(21) Appl. No.: 09/570,058

(22) Filed: May 12, 2000

Related U.S. Application Data

(63) Continuation of application No. 09/204,071, filed on Dec. 3, 1998, now abandoned.

(30) Foreign Application Priority Data

Apr. 3, 1998 (JP) ..... 10-91859

(51) Int. Cl.[7] ..... E04H 15/20

(52) U.S. Cl. ..... 52/2.11; 52/2.23; 52/2.24; 52/2.22; 52/88; 900/904

(58) Field of Search ..... 52/2.23, 2.24, 52/88, 2.11, 2.22; 135/900, 906

(56) References Cited

FOREIGN PATENT DOCUMENTS

1961523 A 9/1970 (DE) .
2044871 10/1980 (GB) .
2135354 A 8/1984 (GB) .
60-242269 10/1985 (JP) .
5-5025 1/1993 (JP) .
9-144382 6/1997 (JP) .

*Primary Examiner*—Beth A. Stephan
*Assistant Examiner*—Dennis L. Dorsey
(74) *Attorney, Agent, or Firm*—Rader, Fishman & Grauer

(57) ABSTRACT

A pneumatic structure in the form of a barrel roof which has openings at the opposite ends thereof includes outer and inner walls of a sheet or membrane material connected by a plurality of partition walls in the form of ribs provided therebetween to define a plurality of air compartments in the form of ribs between the outer and inner walls. The partition walls includes a plurality of openings for fluid communication between adjacent air compartments. The pneumatic structure has specific dimensions defined as follows.

$1.20 \leqq b/a \leqq 1.35$ $1.10 \leqq d/c \leqq 1.35$ $0.2 \leqq a/c \leqq 0.5$ where a: the maximum opening width of the pneumatic structure;

b: the total width of the pneumatic structure;

c: the effective height (between ground and the maximum height of the inner wall; and d: the total height (between ground and the maximum height of the outer wall.

22 Claims, 12 Drawing Sheets

PNEUMATIC STRUCTURE

This application is a continuation of application Ser. No. 09/204,071 filed Dec. 3, 1998 abandoned.

BACKGROUND OF THE INVENTION

1. Field of the Invention

The invention relates to a pneumatic structure in the form of a barrel roof which is adapted to be provided over the entirety or a portion of a working or living space, such as a work site for maintaining or painting a watercraft, a construction site, a temporary site for an exhibition, or a stadium, and permits activity even under rain or snow. In particular, the invention relates to a pneumatic structure which is light and is capable of bearing a wind or snow load.

2. Description of the Related Art

Rain or snow often interrupts an outside work which decreases the efficiency of the work. However, there are cases in which the schedule cannot be delayed. Thus, in order to ensure a working or living space such as a work site for maintaining and painting a watercraft, a construction site, a temporary site for an exhibition, or a stadium, and to permit activity even under rain or snow (in the following description, "working or living space" is referred to as "working space"), pneumatic structures in the form of a barrel roof have been developed. Such pneumatic structures include one for semi-permanent use and one for temporary use.

Japanese Unexamined Patent Publication (Kokai) No. 9-144382, which was filed on Jun. 4, 1998 by the applicant, describes a pneumatic structure for temporary use. The pneumatic structure includes outer and inner sheets or membranes connected by reinforcement sheets or membranes in the form of ribs, which define a plurality of air compartments into which compressed air is introduced to inflate the structure. The partition walls include openings which allow air to flow between the air compartments.

The pneumatic structure of the prior art is capable of protecting a working space from rain, but heavy snow and gales, for example winds over 10 m/sec collapse the pneumatic structure. This problem is serious in case of a large structure since the larger the structure, the larger the snow or wind load on the structure.

In addition to the above problems, in order to provide a larger working space, a larger pneumatic structure is required. This increases the weight and the labor for transportation, installation, and deinstallation of the structure.

SUMMARY OF THE INVENTION

The invention is directed to solve the problems of the prior art, and to provide a pneumatic structure improved to facilitate transportation, installation, and deinstallation even if the size of the structure is increased.

The objective of the invention is also to provide a pneumatic structure improved to increase its strength against snow or wind loads.

The invention provides a pneumatic structure in the form of a barrel roof which has openings at the opposite ends thereof. The pneumatic structure comprises outer and inner walls of a sheet or membrane material connected by a plurality of partition walls in the form of ribs provided therebetween to define a plurality of air compartments in the form of ribs between the outer and inner walls; the partition walls including a plurality of openings for fluid communication between adjacent air compartments.

According to another feature of the invention, there is provided a pneumatic structure assembly in the form of a barrel roof which has openings at the opposite ends thereof. The pneumatic structure assembly comprises at least two pneumatic structure portions which are connected to each other at the ends of the respective structure portions. Each of the pneumatic structures comprises outer and inner walls of a sheet or membrane material connected by a plurality of partition walls in the form of ribs provided therebetween to define a plurality of air compartments in the form of ribs between the outer and inner walls; and an abutment, provided at an end of the structure portion, for contacting the abutment portion of the other pneumatic structure portion when the two pneumatic structure portions are connected to each other. The partition walls including a plurality of openings for fluid communication between adjacent air compartments.

The pneumatic structure has specific dimensions defined as follows.

$$1.20 \leqq b/a \leqq 1.35$$

$$1.10 \leqq d/c \leqq 1.35$$

$$0.2 \leqq a/c \leqq 0.5$$

where a: the maximum opening width of the pneumatic structure;

b: the total width of the pneumatic structure;

c: the effective height (between ground and the maximum height of the inner wall; and d: the total height (between ground and the maximum height of the outer wall.

DESCRIPTION OF THE DRAWINGS

These and other objects and advantages and further description will now be discussed in connection with the drawings in which.

DESCRIPTION OF THE PREFERRED EMBODIMENTS

Figure 1:
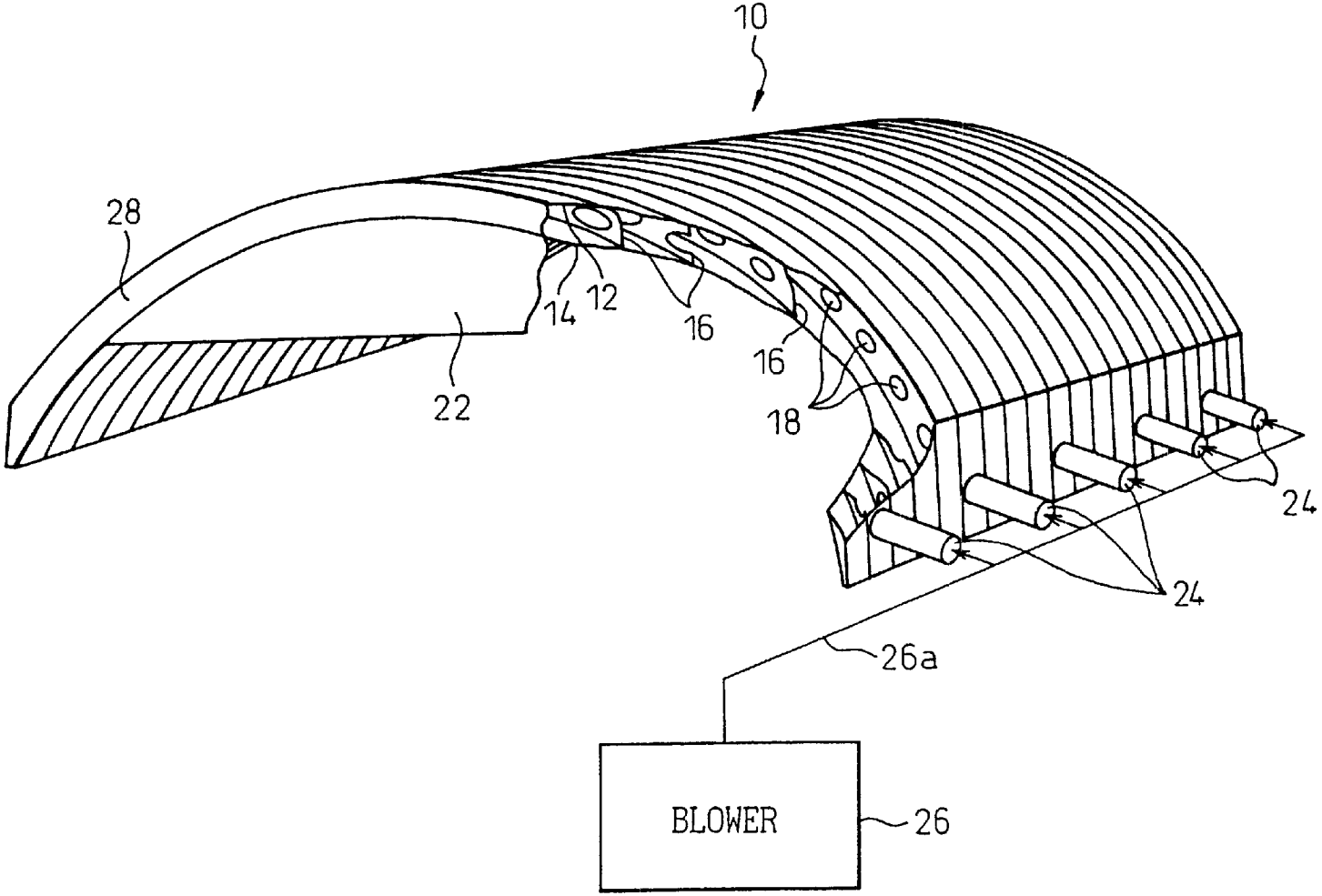
FIG. 1 is a partially sectional perspective view of a pneumatic structure of the invention.
Figure 4:
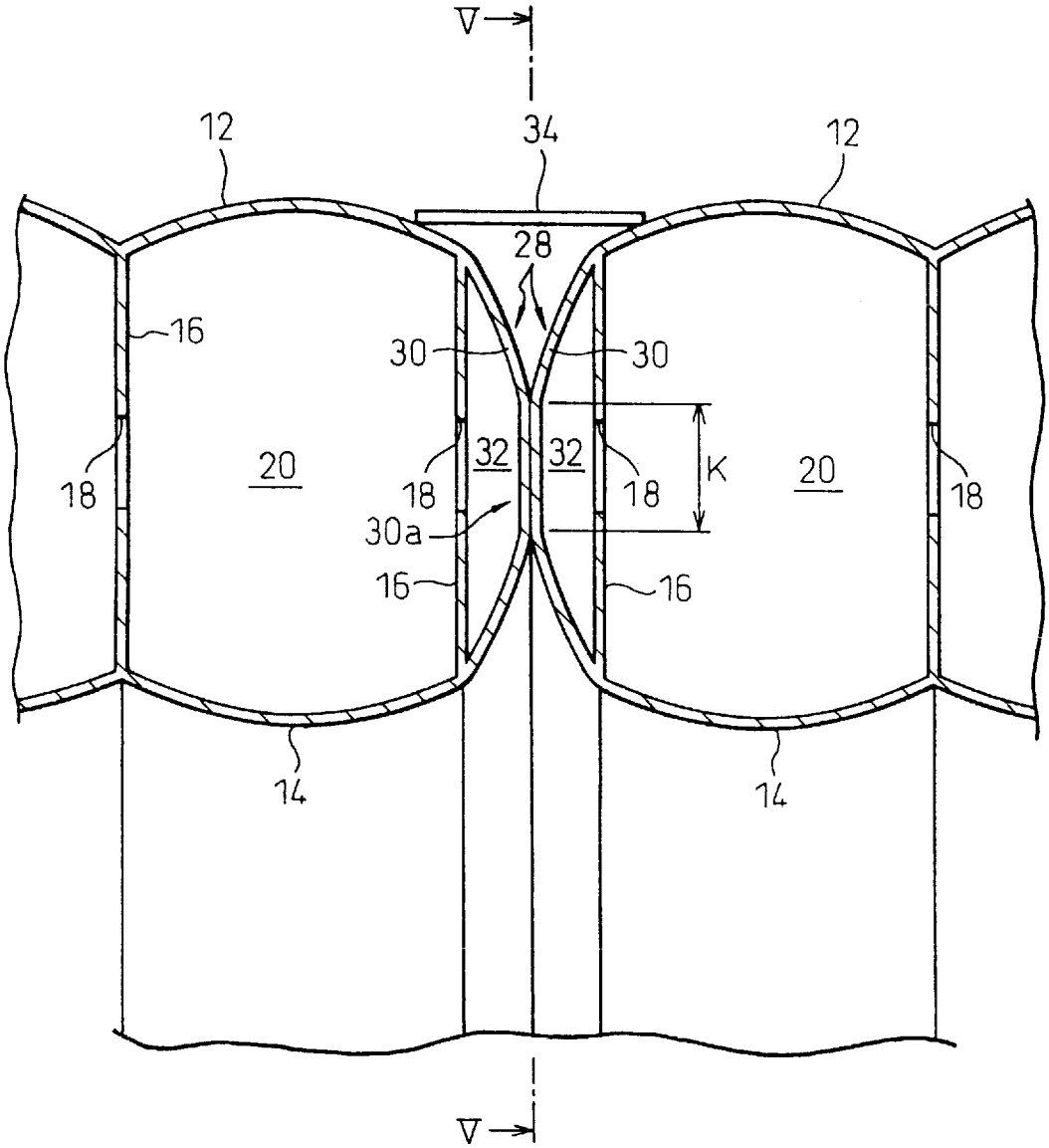
FIG. 4 is an enlarged section of a portion indicated by "A" in FIG. 3.

With reference to FIG. 1, a pneumatic structure 10 according to the invention comprises outer and inner walls 12 and 14 which are connected by a plurality of partition walls 16 in the form of ribs to define a plurality of air compartments 20 (refer to FIG. 4). The partition walls 16 include openings 18 to allow air to flow between the air compartments 20. The pneumatic structure 10 further includes screens 22 and abutments 28 at both ends of the structure 10.

An air source 26, including for example a fan, a blower or a compressor, supplies compressed air into the air compartments through conduit 26*a* and at least one of a plurality of ports 24 to inflate the structure 10. Providing the air source 26 with a heater (not shown) to supply hot air into the air compartments can melt snow accumulated on the pneumatic structure 10.

The outer, inner and partition walls comprise a sheet or membrane material of a woven fabric or knitted fabric from a high-tenacity fiber, such as a polyester fiber, a polyamide fiber, an aramid fiber, a carbon fiber, a polyolefine fiber, or a polyacrylate fiber, and preferably a polyester fiber, and an aramid fiber. Applied onto the fabric is a resin material such as polyurethane or vinyl chloride, or a rubber material such as acrylic rubber or fluoro rubber, to provide impermeability as described below.

Further, the sheet or membrane material has a density which falls within a range of 30–200 g/m$^2$, preferably 30–50 g/m$^2$. In case of the density larger than 200 g/m$^2$, the weight of the pneumatic structure increases and the relatively high rigidity of the sheet impairs the handling of the structure. On the contrary, in case of density less than 30 g/m$^2$, the strength of the sheet material is too low for the structure. In particular, for a relatively large sized pneumatic structure, the density of the sheet or membrane material is preferably selected within a range of 30–50 g/m$^2$ to reduce the weight of the structure.

Further, the air permeability of the sheet of membrane material is selected within a range of 0.1 cc/sec-m$^2$ or less, preferably 0.02 cc/sec-m$^2$ or less. In the most preferable case, an impermeable sheet material is used. Incidentally, the permeability is in compliance with "JIS L1096 Test Method For General Fabric", in which air flow per unit area and time through a sample fabric per is determined under differential pressure of 1.27 cm-Hg.

The configuration of the partition walls 16 is described below.

The partition walls 16, in the form of ribs, extend parallel to each other between the outer and inner walls 12 and 14 at an interval of 20–100 cm. The partition walls 16 are connected to the outer and inner walls 12 and 14 to reinforce the pneumatic structure 10. As described above, the partition walls 16 include a plurality of openings 18 which allow an air flow between the air compartments. Preferably, the openings 18 have a total area which is 1/400–1/2 of that of the partition walls 16. The upper limit of the area of the openings 18 is determined by the strength of partition walls 16. On the other hand, the lower limit of the total area of the openings 18 is determined by air flow between the air compartments, that is the time required by charge and discharge air into and from the structure. The preferable shape of the openings 18 is a circle or an ellipse.

Figure 2:
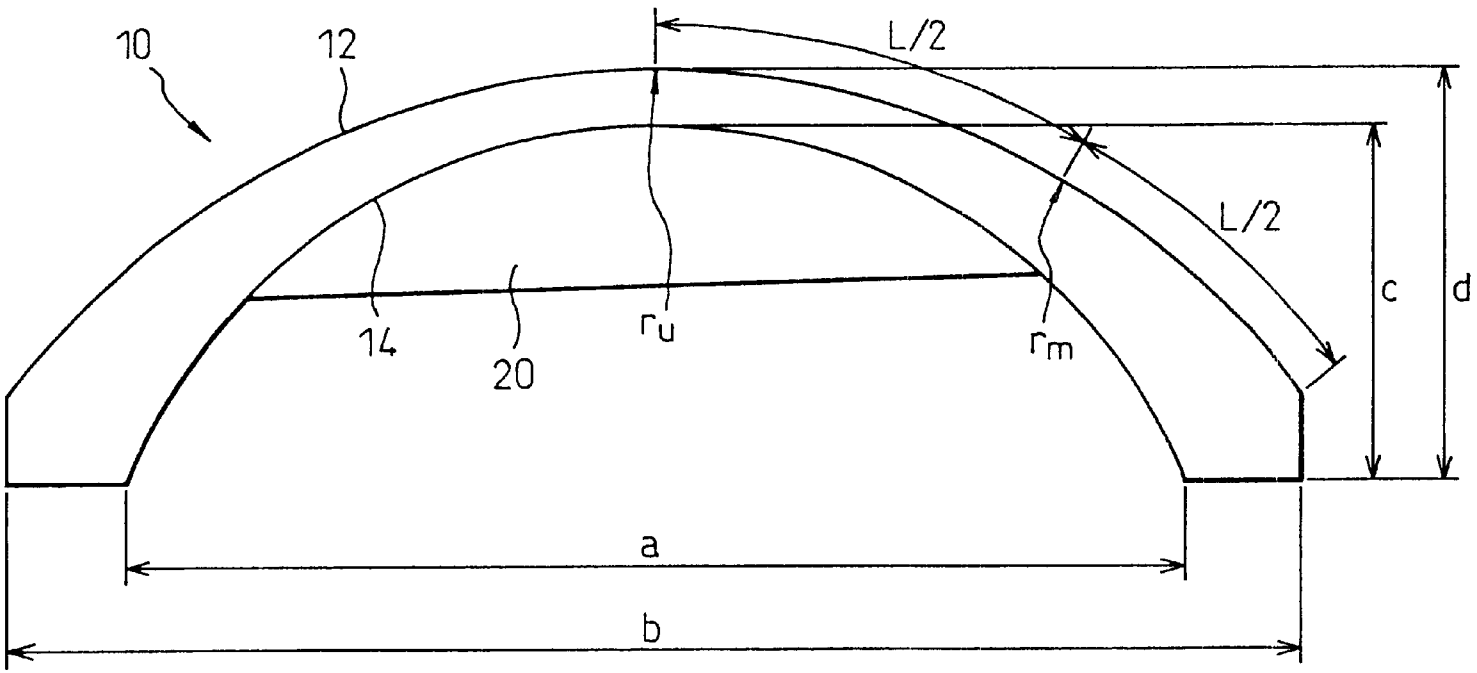
FIG. 2 is a front view of the pneumatic structure of FIG. 1.

According to the feature of the invention, the pneumatic structure 10 has specific dimensions as shown in FIG. 2. In FIG. 2, "a" is the maximum opening width, "b" is the total width, "c" is the effective height (between ground and the maximum height of the inner wall 14), "d" is the total height (between ground and the maximum height of the outer wall 12), "ru" is the radius of curvature of the outer wall at the top of the structure, and "rm" is also radius of curvature of the outer wall at the middle point along the outer wall between the top and the bottom of the structure.

According to the embodiment of the invention, the ratio of the total width "b" and the maximum opening width "a", that is b/a, preferably falls in a range of 1.20–1.35. The pneumatic structure which has the ratio b/a less than 1.20 tends to collapse due to snow or wind load. On the other hand, if the ratio b/a is more than 1.35, the effective area of the pneumatic structure 10 usable for working is notably reduced relative to the total installed area, which results in an economic problem.

Further, according to the embodiment of the invention, the ratio of the total height "d" and the effective height "c", that is d/c, preferably falls in a range of 1.10–1.35. The pneumatic structure which has a ratio d/c of less than 1.10 tends to collapse due to a load such as a snow or wind load. On the other hand, a ratio d/c of more than 1.35 increases the amount of the material and thus the weight of the pneumatic structure to deteriorate the handling thereof. Further, the ratio d/c more than 1.35 increases the area of the side wall of the pneumatic structure, which receives wind pressure, so that the structure can easily collapse under the wind load.

Further, according to the embodiment of the invention, the ratio of the maximum opening width "a" and the effective height, that is a/c, preferably falls in a range of 0.2–0.5. The ratio a/c less than 0.2 reduces the working space provided by the structure, and flattens the pneumatic structure to accumulate snow on the top of the structure and to make it difficult to remove snow on the top. The ratio more than 0.5 increases a wind load received by the structure, which makes the structure tend to collapse.

Further, according to the invention, the ratio of the radius of curvature ru at the top of the structure and radius of curvature rm at the middle point, that is ru/rm, preferably falls in a range of 1.15–1.30. If the ratio ru/rm is smaller than 1.15, a wind load initially makes corrugations in the outer wall at the middle point. The larger the wind, the larger are the corrugations generated in the outer wall which will lead to the collapse of the structure. In order to prevent this, reinforcement is required for the structure. On the other hand, a ratio ru/rm of larger than 1.30 increases the frontal area of the structure which receives the wind to increase the wind load on the structure. Thus, increasing the ratio ru/rm to more than 1.30 is not effective to improve the strength of the structure.

The pneumatic structure 10 according to the embodiment of the invention has the configuration defined by the parameters as above, which configuration stabilizes the shape of the structure under a wind speed of 10–16 m/sec if the internal pressure is relatively low, for example 0.0037 $Kg/cm^2$-g. Generally, the internal pressure of the pneumatic structure 10 is preferably selected within a range of 0.001–0.05 $Kg/cm^2$-g. An internal pressure less than 0.001 $Kg/cm^2$-g cannot maintain the structure under a snow or wind load. On the other hand, an internal pressure higher than 0.05 $Kg/cm^2$-g entails increase of the strength of the outer, inner and partition walls 12, 14 and 16. This further acquires the increase of weight of the structure 10 and the deteriorate of handling of the structure 10. Furthermore, in order to increase the internal pressure above 0.05 $Kg/cm^2$-g, a large fan, a blower or a compressor as the air source 26 is required to increase the cost therefor.

Figure 3:
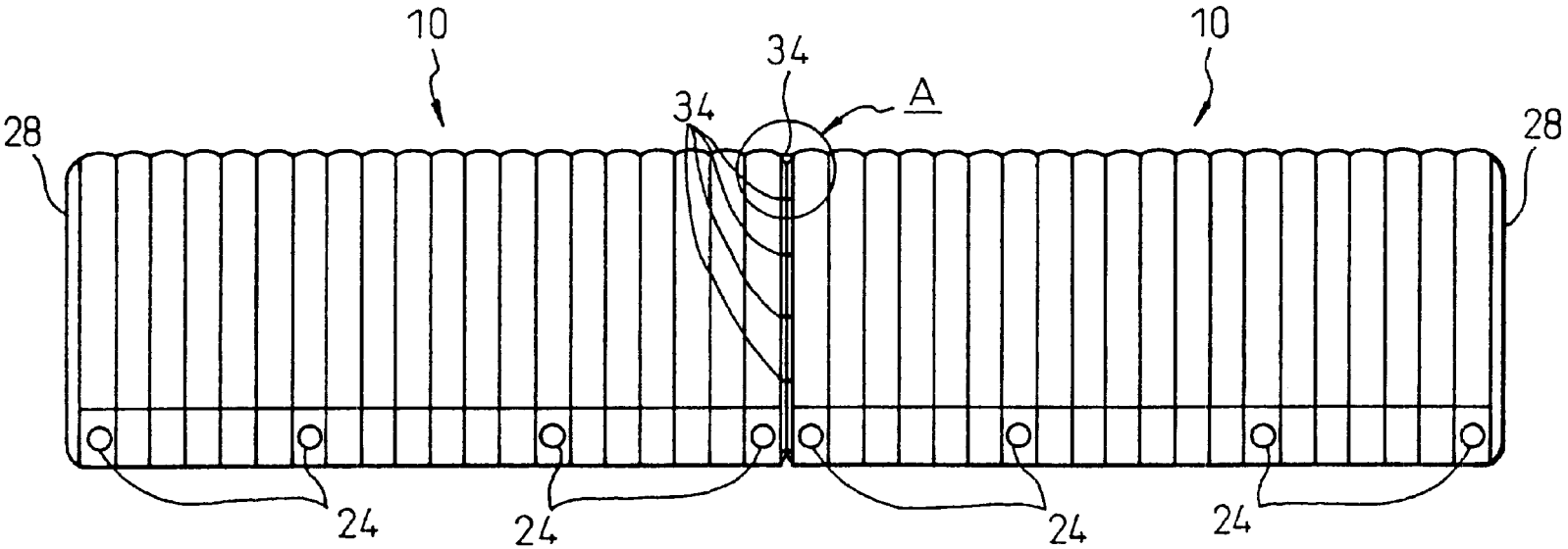
FIG. 3 is a side elevation of a pneumatic structure assembly of the invention.

Although the pneumatic structure 10 is shown as a single body in FIGS. 1 and 2, the invention includes an embodiment in which a plurality of pneumatic structures 10 are connected to each other. With reference to FIGS. 3 and 4, the second embodiment of the invention will be described below.

FIG. 3 shows a pneumatic structure assembly which includes two pneumatic structures 10, as pneumatic structure portions, which are connected to each other by a plurality of bridles 34. The abutments 28 of the respective structures contact each other when the pneumatic structures 10 are connected.

This configuration provides an increased working area without deteriorating the handling of the structure since the size of each of the structure 10 is not increased.

Figure 5:
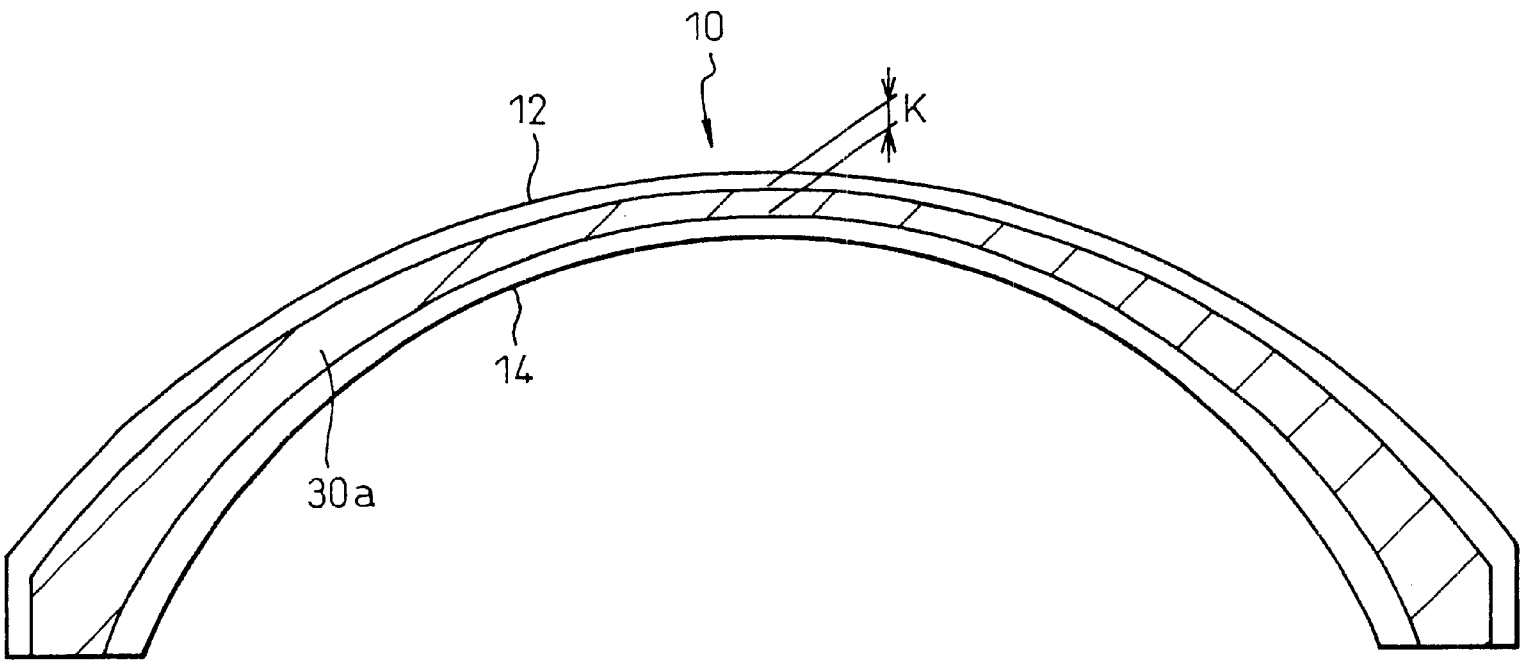
FIG. 5 is a section of the pneumatic structure assembly along line V—V in FIG. 4.

FIG. 4 is an enlarged section of a portion of the connection between the two pneumatic structures 10, indicated by "A" in FIG. 3, and FIG. 5 is an end view along line V—V in FIG. 4.

The abutments 28 are defined by end walls 30 which are made of the same material as the outer and inner walls 12 and 14. The end walls 30 can be made of a material more robust than that of the other walls to reinforce the abutments 28. The end walls 30 define spaces 32 which fluidly communicate with the air compartments 20 through the openings 18 which are provided in the outermost partition walls 16. The abutments 28 of the respective pneumatic structures 10 contact with each other at contacting surfaces 30*a*, shown by hatching in FIG. 5.

In order to prevent water from entering the structure through the connection of the two pneumatic structures 10, the pneumatic structures 10 must be connected so that the contacting surface 30*a* includes a parameter K larger than 4 mm. The parameter K is a minimum dimension of an arbitrary line crossing the contacting surface 30*a*, and generally appears at the top of the structure 10. The larger the parameter K, the higher is the capability of preventing the seepage. However, the authors found that a parameter K larger than 4 mm can practically prevent the seepage. The authors further found that the relationship between the internal pressure P and the parameter K for preventing the seepage is as follows.

$$P\,K \geqq 0.2(Kg/cm^2\ mm) \quad (1)$$

where

P: internal pressure ($Kg/cm^2$-g)

K: minimum dimension of the contacting surface (mm)

Figure 6A:
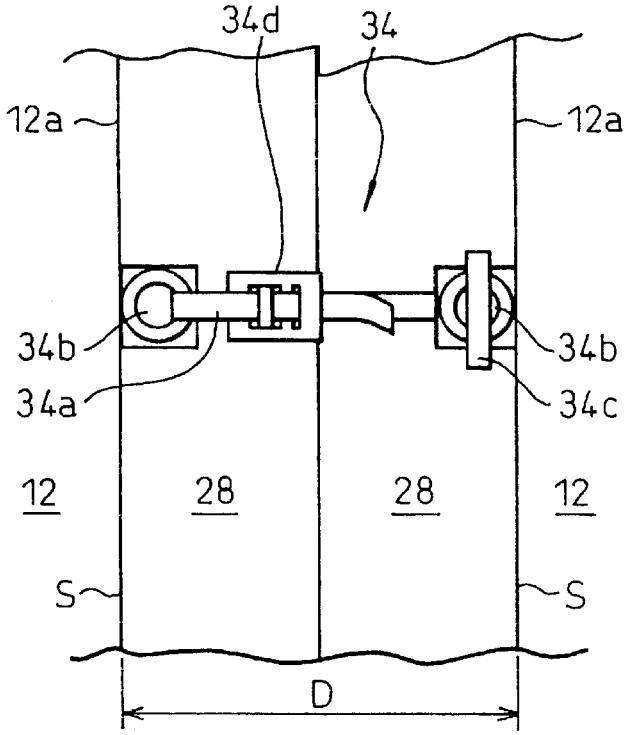
FIG. 6A is an enlarged illustration of a bridle for connecting two pneumatic structures.

FIG. 6A shows an example of the bridle 34 which comprises a band 34*a*, a pair of eyelets 34*b* each of which is provided on the respective pneumatic structures 10 which are connected to each other, a bar 34*c*, which is provided at one end of the band 34*a*, for connecting the end of the band 34*a* to one of the eyelets 34*b*, and a buckle 34*d*. The bar 34*c* is inserted into one of the eyelets 34*b* to connect the end of the band 34*a* to the eyelet 34*b*. The other end of the band 34*a* is threaded into the other eyelet and secured to the band 34*a* by the buckle 34*d*. Each of the eyelets 34*b* is provided in a tab sewed into the seam "S" between the abutments 28 and the outer wall 12. This configuration enables adjustment of the parameter K by adjusting the distance "D" between the connected pneumatic structures 10, that is the length of the bridle 34. Further, the configuration allows the bridles 34 to be separated from the pneumatic structure 10 when it is not connected to another.

Figure 6B:
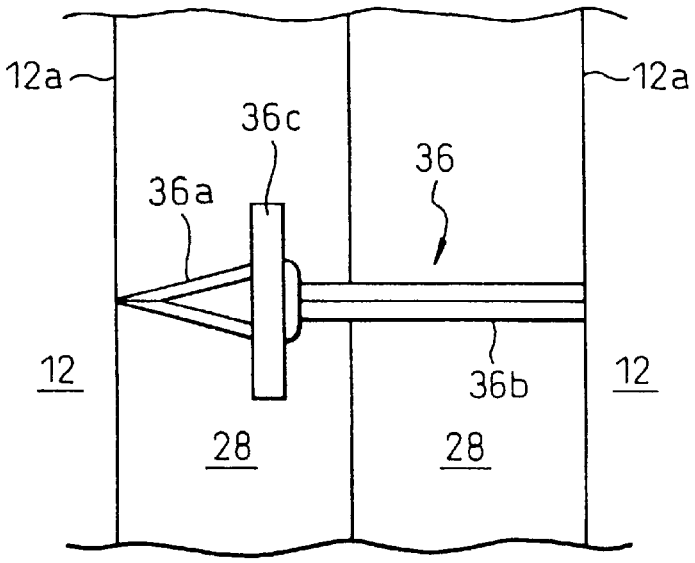
FIG. 6B is an enlarged illustration of another form of the bridle for connecting two pneumatic structures.

FIG. 6B shows another embodiment of the bridle 36 which comprises a first cord 36*a* in the form of a loop, a second corded 36*b*, and a bar 36*c* attached to the end of the second cord 36*b*. The bar 36*c* is inserted into the loop of the first cord 36*a* to connect the first and second cords 36*a* and 36*b* as shown in FIG. 6B.

In FIGS. 3 and 4, although the bridles 34 are shown provided on the exterior of the structures 10, the bridles 34 may be provided also on the interior of the structures 10.

In use, at the installation of the connected form of the pneumatic structures 10, the two pneumatic structures 10 are first connected to each other by the bridles 34 or 36, then air is supplied into the structures 10 by the air source 26 through the conduits 26*a* and the ports 24. After air is supplied, the conduit 26*a* is separated from the ports 24, and the ports 24 may be closed by plugs or closures (not shown). On the other hand, the air is discharged or drawn from each of the connected pneumatic structures 10 through the ports 24 to deflate the structures 10, then the bridles 34 or 36 are disconnected. After the deflation, the structures 10 are folded for storage.

Figure 7A:
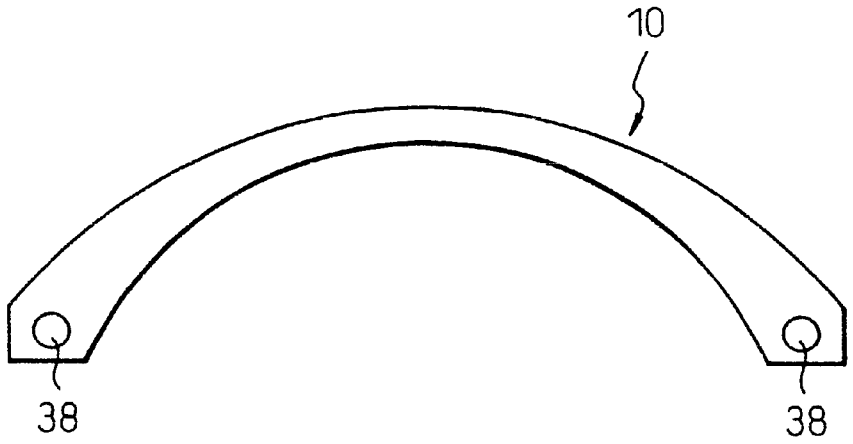
FIG. 7A is an end view of the pneumatic structure along V—V in FIG. 4 in which communication ports are shown.
Figure 7B:
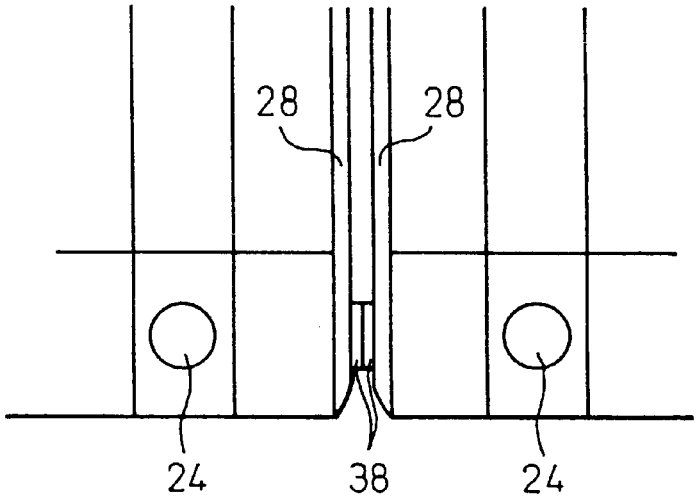
FIG. 7B is an partially enlarged side view of the pneumatic structure assembly for illustrating the connection between two communication ports.

The pneumatic structure 10 may include communication ports 38 in the abutments 28 as shown in FIGS. 7A and 7B. FIG. 7B is a partially enlarged side view of the connection between the two pneumatic structures 10, in which the abutments 28 are illustrated separate from each other to show the communication ports 38 are. The communication ports 38 provided on the respective pneumatic structures 10, which are connected are coupled to each other by a fastener means, such as a zipper fastener, an inter-engaging fastener, or a hook and loop fastener. The communication ports 38 allow air to flow from one structure to the other so that the air conduit, with supplies air to the other structure, can be eliminated. The communication ports 38 can be sealingly closed by a plug, a cap or a closure when the ports 38 are not used.

Figure 8:
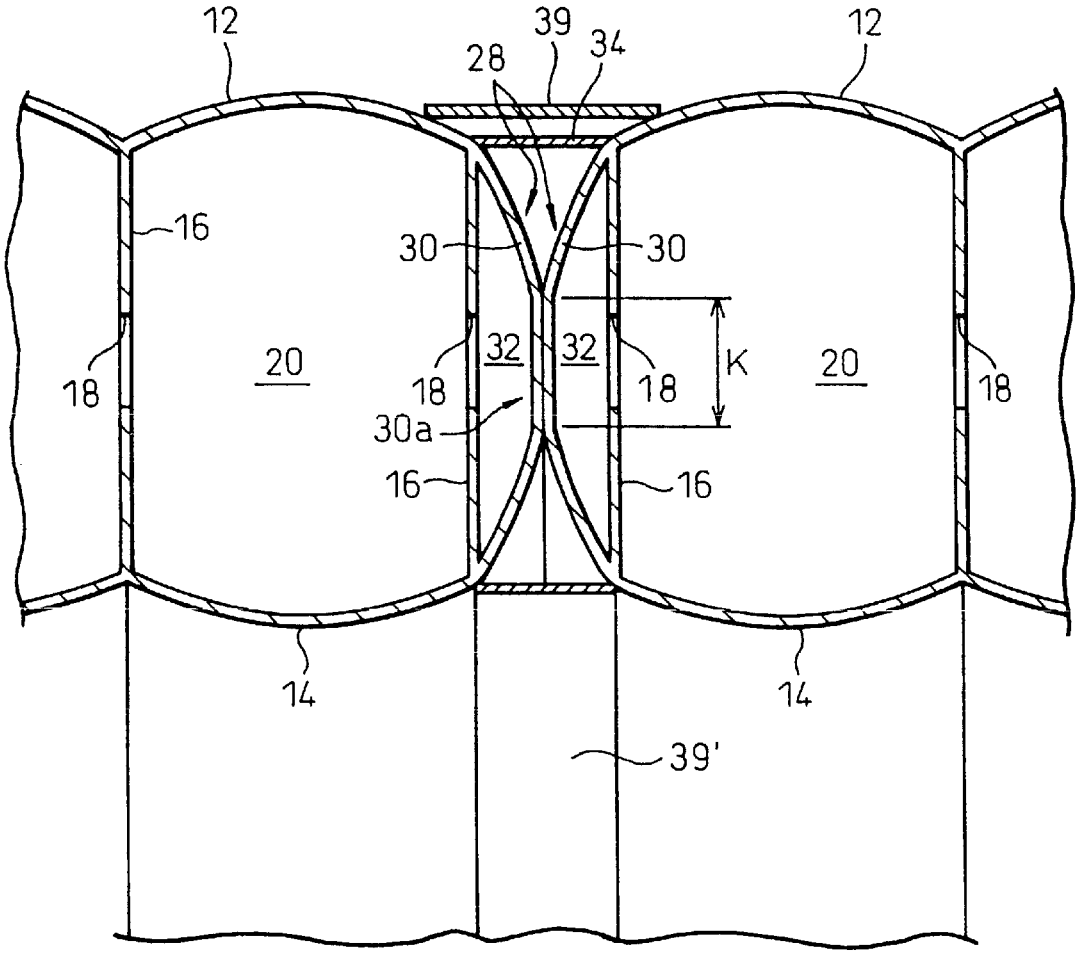
FIG. 8 is an enlarged section similar to FIG. 4 in which an additional cover sheet is shown.

An additional cover sheet 39 may be provided over the connection between the two pneumatic structures 10 for preventing water seepage, improving the appearance, or protecting the connection between the two structures 10. The additional cover sheet 39 may be attached to the structures 10 by a fastener means, such as a zipper fastener, an inter-engaging fastener, or a hook and loop fastener. The invention includes an embodiment, in which an additional cover sheet provided on the inner surfaces of the structure 10. FIG. 8 shows additional cover sheets 39 and 39' which are provided on the outer and inner surfaces of the structure 10.

Figure 9A:
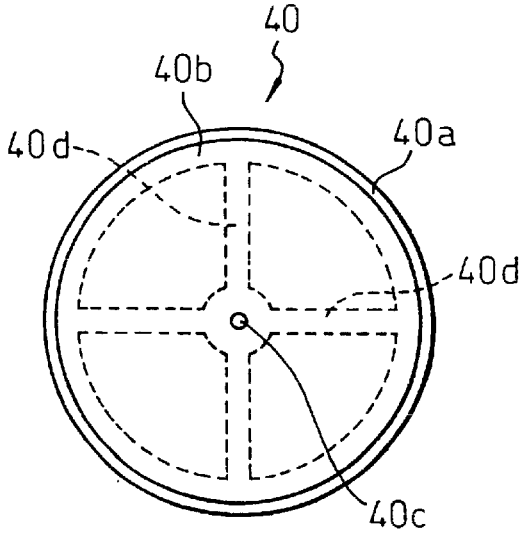
FIG. 9A is a front view of a check valve.
Figure 9B:
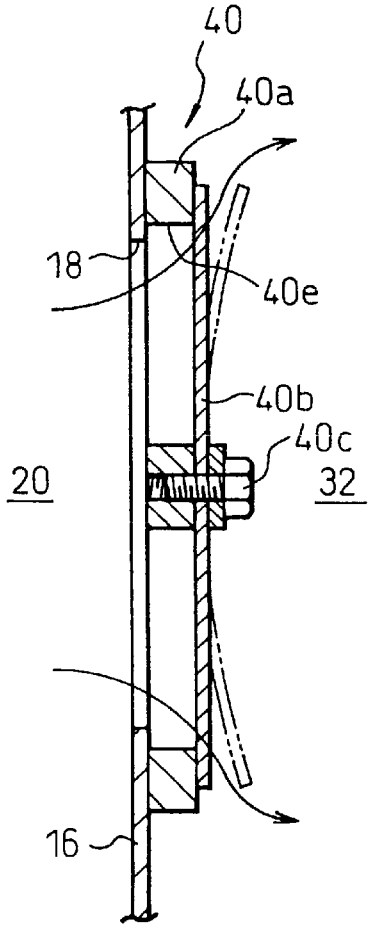
FIG. 9B is a section of the check valve shown in FIG. 9A.

According to another feature of the invention, a check valve 40 may be disposed in the openings 18 to control the air flow in the pneumatic structure 10. The valve 40 comprises a frame 40*a* in the form of a ring, a membrane 40*b* which is attached to an end face of the frame 40*a* by a screw fastener 40*c*, and a cross bar 40*d* for supporting the membrane 40*b*. The membrane 40*b* is flexible to allow one-way air flow as shown in FIG. 9B. Providing the check valves 40 in some of the appropriately selected openings 18 enables control of the air flow in the pneumatic structure 10 so that the resistance to deformation under load is increased. In particular, provision of the check valve 40 between the air compartment 20 and the space 32 of the abutments 28 increases the strength of the abutments 28, which allows the abutments 28 against press to each other when the two pneumatic structures 10 are connected so that the integrity of the pneumatic structure assembly is increased and the water seepage is eliminated.

Another feature of the invention will be described below with reference to FIGS. 10A, 10B and 10C.

Figure 10A:
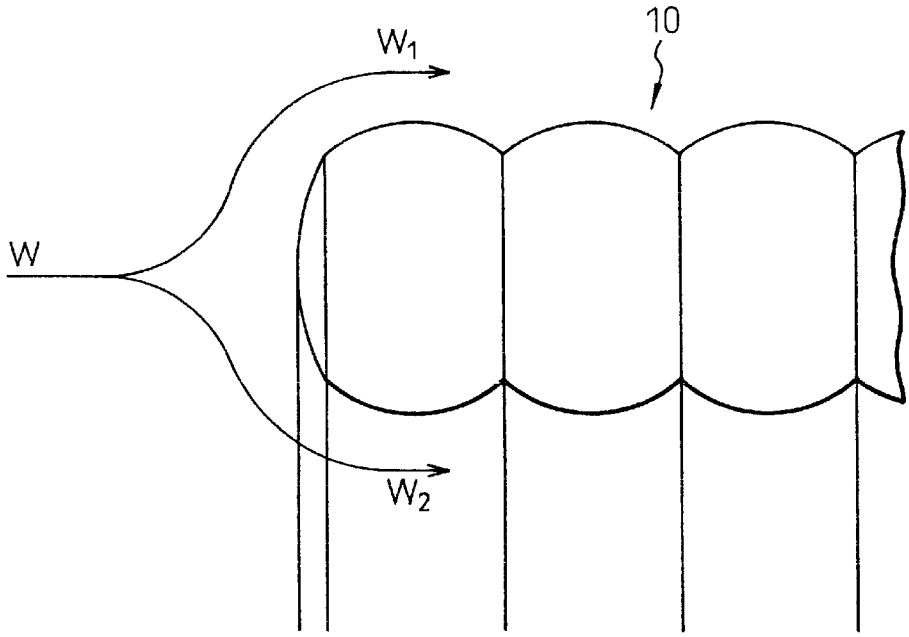
FIG. 10A is partially sectional view of the front top portion of the pneumatic structure shown in FIG. 1.
Figure 10B:
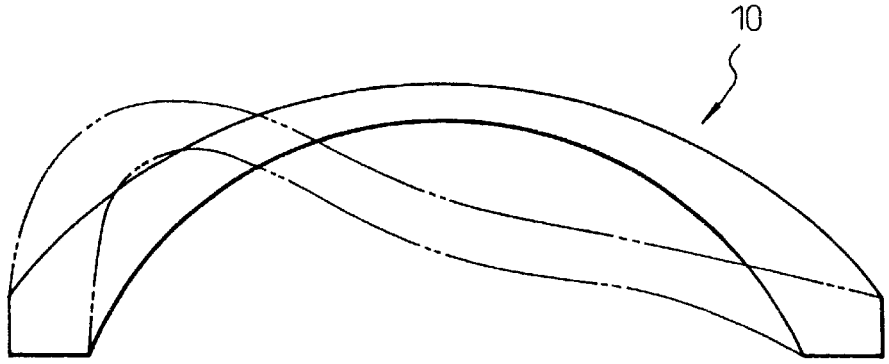
FIG. 10B is a schematic illustration of the deformation of the pneumatic structure by a wind load without a screen for reinforcement.
Figure 10C:
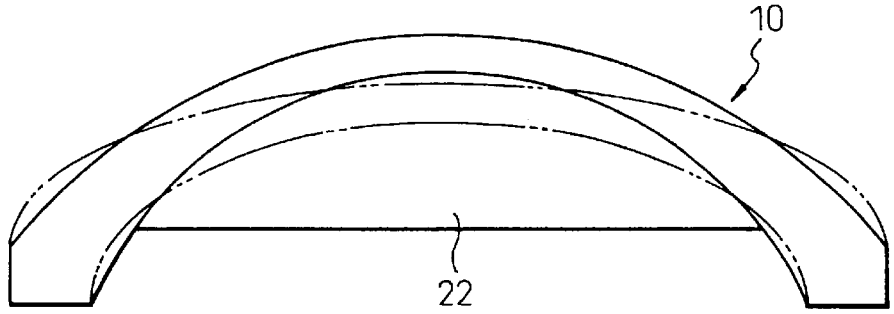
FIG. 10C is a schematic illustration of the deformation of the pneumatic structure by a wind load with a screen for reinforcement.

FIG. 10A is a partially sectional view of the front top portion of the pneumatic structure, in which a wind "W" flows into the structure. When the wind "W" meets the structure 10, the wind "W" is divided into an upper flow "W1" and a lower flow "W2" by the front top portion of the structure as shown in FIG. 10A. The separated flows "W1" and "W2" generate a fluid dynamic force which acts on and deforms the front top portion of the structure. Some conditions induce a self-oscillation in the structure to deform or collapse the entire structure as shown by dashed line in FIG. 10B.

The pneumatic structure 10 of the invention includes the screens 22 (FIGS. 1 and 11A) for preventing this phenomena. The screen 22 may be made of woven, non-woven or knitted fabric. Further, the screen 22 can be made of a metallic or plastic plate or sheet.

The screens 22 are provided to the upper portion of the opening of the structure 10 at the both ends thereof. The screens 22 reduce the lower flow "W2" to reduce the fluid dynamic force on the structure 10, and increase the strength of the structure. FIG. 10C schematically shows the deformation of the pneumatic structure with a screen for reinforcement by a wind load. The screens 22 can be detachably or fixedly attached to the structure 10. In case that the screens 22 are detachably attached to the structure 10, a fastener means, such as a zipper fastener, an inter-engaging fastener, a hook and loop fastener or an eyelet and cord assembly can be used. Detaching the screens 22 increases the size, in particular the height of the openings of the structure 10, which allows a relatively high machine or a falsework to enter the structure 10, and provides lighting. A reinforcement bar 42 may be provided at the lower end of the screen 22 as shown in FIG. 11A.

Figure 11A:
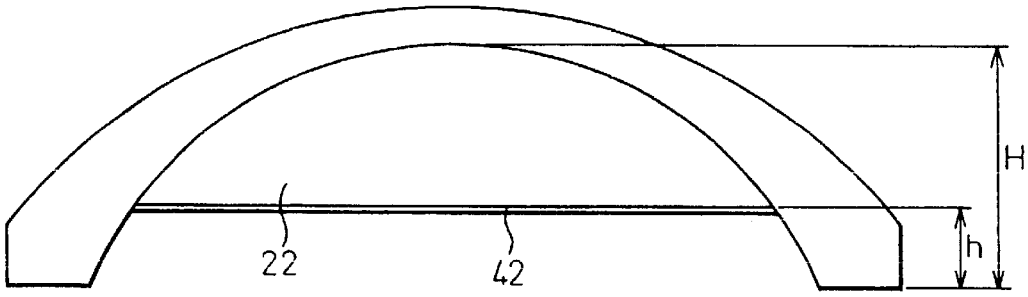
FIG. 11A is a front view of the pneumatic structure with the screen.

With reference to FIG. 11A, the screen 22 preferably has an effective opening height "h", between the lower end of the screen and the ground, and a maximum height "H", that is "C" in FIG. 2. According to the embodiment of the invention, the effective opening height "h" and the maximum height "H", that is h/H is required to satisfy the following condition.

$$h/H \leqq 0.8 \quad (2)$$

The ratio h/H larger than 0.8 reduces the reinforcement effect and the obstruction effect for the lower flow "W2". Further, the effective opening height "h" is preferably at least 2 m, for allowing the access to the structure 10, and the maximum height "H" is preferably at least 2.5 m, to ensure sufficient working space in the structure 10.

Figure 11B:
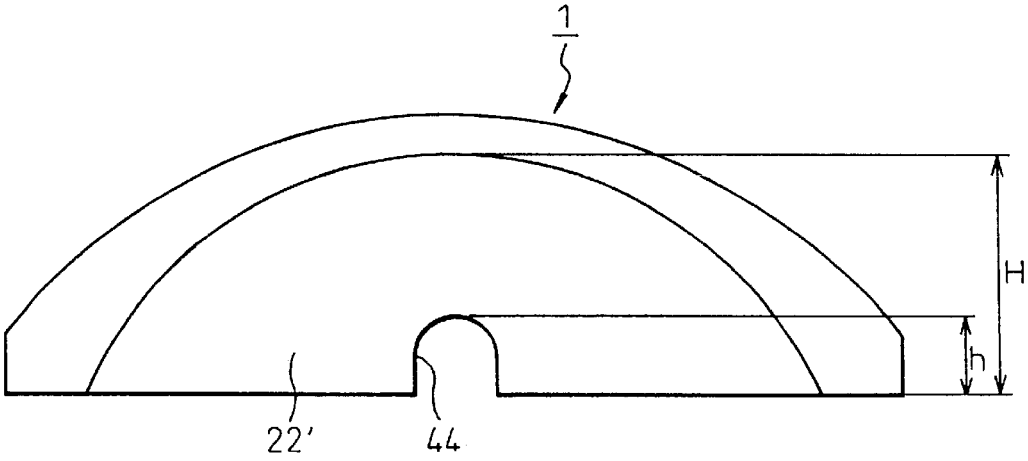
FIG. 11B shows another form of the screen.

FIG. 11B shows a screen 22' according to another embodiment of the invention The screen 22' substantially closes the opening of the structure 10 and includes an access opening 44. In this case, the effective height "h" is defined by the height of the access opening 44 as shown in FIG. 11B.

Figure 12A:
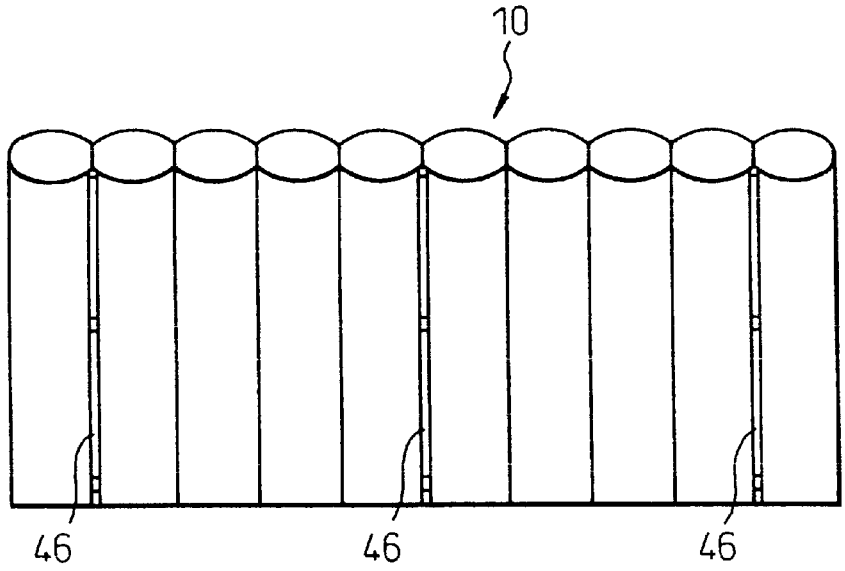
FIG. 12A is a section of the pneumatic structure with three reinforcements extending along inner surface of the structure.
Figure 12B:
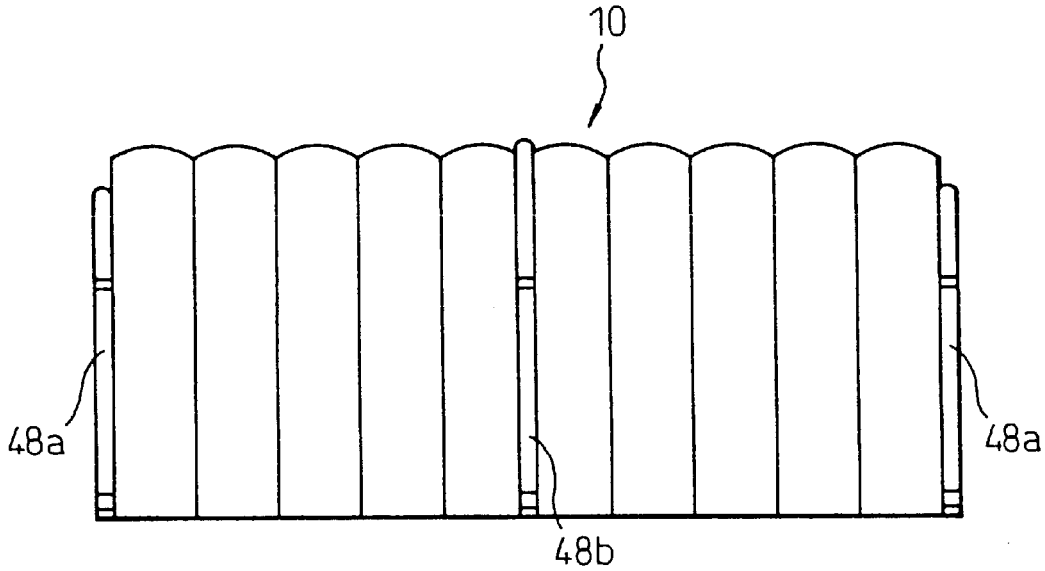
FIG. 12B is a side view of the pneumatic structure with three reinforcements extending along outer surface of the structure.

The pneumatic structure 10 may include at least a reinforcement in the form of an arch. FIG. 12A is a side section of the structure 10 in which three reinforcements 46 provided along the inner surface of the structure 10, and FIG. 12B is a side view of the structure 10 in which two reinforcements 48*a* are provided at the ends of the structure 10 and one reinforcement 48*b* is provided along the outer surface of the structure 10. The reinforcements 46, 48*a* and 48*b* may be made of a metal or plastic material or an air tube in the form of an arch or a semicircle. The reinforcement in the form of an air tube can be made of a woven fabric or knitted fabric made from a high-tenacity fiber, such as a polyester fiber, a polyamide fiber, an aramid fiber, a carbon fiber, a polyolefine fiber, or a polyacrylate fiber, and preferably a polyester fiber and an aramid fiber. Applied onto the fabric is a resin material such as polyurethane or vinyl chloride, or a rubber material such as acrylic rubber or fluoro rubber to provide impermeability.

The air tube can be made of a sheet material which has a density of 100–600 g/m$^2$. If the density is larger than 600 g/m$^2$, the rigidity of the sheet is too high to impair the handling of the reinforcement. On the contrary, if the density is less than 100 g/m$^2$, the strength of the sheet material is too low for the reinforcement.

The reinforcements are attached to the structure by a fastener means, such as a zipper fastener, an inter-engaging fastener, a hook and loop fastener or an eyelet and cord assembly. In case of an air tube, the reinforcements can be integrally connected to the structure 10.

It will also be understood by those skilled in the art that the forgoing description is a preferred embodiment of the disclosed device and that various changes and modifications may be made without departing from the spirit and scope of the invention.

We claim:

1. A pneumatic structure in the form of a barrel roof which has openings at the opposite ends thereof, comprising:

outer and inner walls of a sheet or membrane material comprising a woven fabric of a polyester or aramid fiber;

a plurality of partition walls in the form of ribs provided between, and connecting, the outer and inner walls to define a plurality of air compartments in the form of ribs between the outer and inner walls; and a plurality of openings to allow fluid communication between adjacent air compartments, wherein an internal pressure is at least 0.001 kg/cm$^2$-g; and wherein the pneumatic structure has specific dimensions defined as follows:

$$1.20 \leqq b/a \leqq 1.35$$

$$1.10 \leqq d/c \leqq 1.35$$

$$0.2 \leqq a/c \leqq 0.5$$

where a: a maximum opening width of the pneumatic structure;

b: a total width of the pneumatic structure;

c: an effective height between ground and a maximum height of the inner wall; and d: a total height between ground and a maximum height of the outer wall.

2. A pneumatic structure according to claim 1 wherein the pneumatic structure further has specific dimensions defined as follows:

$$1.15 \leqq ru/rm \leqq 1.30$$

where ru: radius of curvature of the outer wall at the top of the structure; and rm: radius of curvature of the outer wall at the middle point along the outer wall between the top and the bottom of the structure.

3. A pneumatic structure according to claim 2 further comprising screens, provided at the ends of the structure, for preventing the deformation of the structure at the ends thereof.

4. A pneumatic structure according to claim 3 wherein the screens have specific dimensions defined as follows:

$$h/H \leqq 0.8$$

$$h \geqq 2(m)$$

$$H \geqq 2.5(m)$$

h: an effective opening height between the lower end and the ground where the structure is installed; and H: a total height between ground and the maximum height of the outer wall.

5. A pneumatic structure according to claim 4 wherein the screens are detachably attached to the ends of the structure.

6. A pneumatic structure according to claim 5 wherein the screens comprise a knitted material.

7. A pneumatic structure according to claim 4 wherein the screens include a reinforcement bar extending along the lower end of the screen.

8. A pneumatic structure according to claim 5 wherein the screens are integrally connected to the inner wall.

9. A pneumatic structure according to claim 1 wherein the material defining the outer and inner walls has a density which falls within a range of 30–200 g/m$^2$, and an air permeability within a range of 0.1 cc/sec-m$^2$.

10. A pneumatic structure according to claim 1 further comprising at least a check valve, provided in the opening in the partition walls, for controlling the air flow in the pneumatic structure.

11. A pneumatic structure according to claim 1 further comprising at least a reinforcement member in the form of an arch, the reinforcement comprising an air tube of a sheet material which has a density of 100–600 g/m$^2$.

12. A pneumatic structure assembly in the form of a barrel roof which has openings at the opposite ends thereof, comprising:

at least two pneumatic structure portions which are connected to each other at the ends of the respective structure portions;

each of the pneumatic structures comprising:

outer and inner walls of a sheet or membrane material comprising a woven fabric of a polyester or aramid fiber;

a plurality of partition walls in the form of ribs provided between, and connecting, the outer and inner walls to define a plurality of air compartments in the form of ribs between the outer and inner walls;

an abutment at an end of each pneumatic structure portion contacting an opposite abutment portion of the other pneumatic structure portion; and a plurality of openings to allow fluid communication between adjacent air compartments, wherein an internal pressure is at least 0.001 kg/cm$^2$-g; and wherein each pneumatic structure has specific dimensions defined as follows:

$$1.20 \leqq b/a \leqq 1.35$$

$$1.10 \leqq d/c \leqq 1.35$$

$$0.2 \leqq a/c \leqq 0.5$$

where a: a maximum opening width of the pneumatic structure;

b: a total width of the pneumatic structure;

c: an effective height between ground and a maximum height of the inner wall; and d: a total height between ground and a maximum height of the outer wall.

13. A pneumatic structure according to claim 12 wherein the pneumatic structure further has specific dimensions defined as follows:

$$1.15 \leqq ru/rm \leqq 1.30$$

where ru: radius of curvature of the outer wall at the top of the structure; and rm: radius of curvature of the outer wall at the middle point along the outer wall between the top and the bottom of the structure.

14. A pneumatic structure according to claim 13 further comprising screens, provided at the ends of the structure, for preventing the deformation of the structure at the ends thereof.

15. A pneumatic structure according to claim 14 wherein the screens have specific dimensions defined as follows:

$$h/H \leqq 0.8$$

$$h \geqq 2(m)$$

$$H \geqq 2.5(m)$$

h: an effective opening height between the lower end and the ground where the structure is installed; and H: a total height between ground and the maximum height of the outer wall.

16. A pneumatic structure according to claim 15 wherein the screens are detachably attached to the ends of the structure.

17. A pneumatic structure according to claim 16 wherein the screens comprise a knitted material.

18. A pneumatic structure according to claim 15 wherein the screens include a reinforcement bar extending along the lower end of the respective screens.

19. A pneumatic structure according to claim 16 wherein the screens are integrally connected to the inner wall.

20. A pneumatic structure according to claim 12 wherein the material defining the outer and inner walls has a density which falls within a range of 30–200 g/m$^2$, and an air permeability within a range of 0.1 cc/sec-m$^2$.

21. A pneumatic structure according to claim 12 further comprising at least a check valve, provided in the opening in the partition walls, for controlling the air flow in the pneumatic structure.

22. A pneumatic structure according to claim 12 further comprising at least a reinforcement member in the form of an arch, the reinforcement comprising an air tube of a sheet material which has a density of 100–600 g/m$^2$.

* * * * *